US009726164B2

(12) United States Patent
Kang et al.

(10) Patent No.: US 9,726,164 B2
(45) Date of Patent: Aug. 8, 2017

(54) LINEAR COMPRESSOR

(71) Applicant: LG ELECTRONICS INC., Seoul (KR)

(72) Inventors: Kyoungseok Kang, Seoul (KR); Wonhyun Jung, Seoul (KR); Chulgi Roh, Seoul (KR); Sangsub Jeong, Seoul (KR); Kiwook Song, Seoul (KR); Jookon Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 160 days.

(21) Appl. No.: 14/317,172

(22) Filed: Jun. 27, 2014

(65) Prior Publication Data

US 2015/0004017 A1 Jan. 1, 2015

(30) Foreign Application Priority Data

Jun. 28, 2013 (KR) ..... 10-2013-0075512
Jun. 28, 2013 (KR) ..... 10-2013-0075514
Oct. 4, 2013 (KR) ..... 10-2013-0118581

(51) Int. Cl.
*F04B 39/00* (2006.01)
*F04B 35/04* (2006.01)
*F04B 39/14* (2006.01)

(52) U.S. Cl.
CPC ..... *F04B 39/0044* (2013.01); *F04B 35/045* (2013.01); *F04B 39/0005* (2013.01); *F04B 39/14* (2013.01)

(58) Field of Classification Search
CPC ..... F04B 39/044; F04B 39/0005; F04B 39/14
(Continued)

(56) References Cited

U.S. PATENT DOCUMENTS 3,007,625 A * 11/1961 Dolz ..... F04B 35/045 417/416
3,143,281 A * 8/1964 Dolz ..... F04B 35/045 123/169 PA
(Continued)

FOREIGN PATENT DOCUMENTS

CN 1480648 3/2004
CN 1508427 6/2004
(Continued)

OTHER PUBLICATIONS

European Search Report dated Sep. 17, 2015.
(Continued)

*Primary Examiner* — Charles Freay
*Assistant Examiner* — Christopher Bobish
(74) *Attorney, Agent, or Firm* — KED & Associates, LLP

(57) ABSTRACT

A linear compressor is provided that may include a shell including a refrigerant inlet, a cylinder provided within the shell, a piston reciprocated within the cylinder, the piston having a flow space in which a refrigerant may flow, a motor assembly that provides a drive force, the motor assembly including a permanent magnet, a flange that extends from an end of the piston in a radial direction, the flange having an opening that communicates with the flow space of the piston and a coupling hole defined outside of the opening, a support coupled to the coupling surface of the flange to support a plurality of springs, and at least one reinforcing rib that protrudes from the coupling surface to guide deformation of the flange while the flange and the support are coupled to each other.

24 Claims, 12 Drawing Sheets

(58) Field of Classification Search
USPC ..... 417/415, 417, 545
See application file for complete search history.

(56) References Cited

U.S. PATENT DOCUMENTS 3,813,192 A * 5/1974 Adams ..... H02K 33/18 417/416
4,027,211 A * 5/1977 Omura ..... H02K 33/18 310/27
4,827,163 A 5/1989 Bhate et al.
4,924,675 A 5/1990 Higham
4,932,313 A 6/1990 Gutknecht
4,937,481 A 6/1990 Vitale
5,559,378 A 9/1996 Oudet et al.
5,693,991 A 12/1997 Hiterer et al.
5,704,771 A * 1/1998 Fujisawa ..... F04B 35/045 417/417
6,097,125 A * 8/2000 Park ..... H02K 1/34 310/12.16
6,273,688 B1 * 8/2001 Kawahara ..... F04B 35/045 417/363
6,328,544 B1 12/2001 Kawahara et al.
6,379,125 B1 * 4/2002 Tojo ..... F04B 35/045 417/417
6,398,523 B1 6/2002 Hur et al.
6,413,057 B1 * 7/2002 Hong ..... F04B 35/045 417/416
6,435,842 B2 * 8/2002 Song ..... F04B 35/045 267/109
6,561,144 B1 5/2003 Muraji
6,575,716 B1 6/2003 Morita et al.
6,666,662 B2 * 12/2003 Oh ..... F04B 35/045 417/417
6,755,627 B2 6/2004 Chang
6,793,470 B2 * 9/2004 Song ..... F04B 35/045 417/417
6,863,506 B2 * 3/2005 Park ..... F04B 35/045 417/360
6,875,000 B2 * 4/2005 Bae ..... F04B 35/045 417/416
6,894,407 B2 5/2005 Jung
6,994,530 B2 * 2/2006 Fujisawa ..... F04B 35/045 310/15
7,288,862 B2 10/2007 Song
7,331,772 B2 * 2/2008 Jung ..... F04B 35/045 417/417
7,404,701 B2 * 7/2008 Kwon ..... F04B 39/0276 252/68
7,478,996 B2 * 1/2009 Kang ..... F04B 35/045 181/229
7,537,438 B2 * 5/2009 Song ..... F04B 35/045 310/15
7,614,856 B2 11/2009 Inagaki et al.
7,617,594 B2 * 11/2009 Hyeon ..... F04B 35/045 29/33 K
7,626,289 B2 12/2009 Her
7,649,285 B2 1/2010 Ueda
7,748,963 B2 * 7/2010 Lee ..... F04B 35/045 417/415
7,748,967 B2 * 7/2010 Park ..... F04B 35/045 137/856
7,775,775 B2 * 8/2010 Cho ..... F04B 35/045 417/244
7,901,192 B2 * 3/2011 Cho ..... F04B 25/00 417/244
7,922,463 B2 * 4/2011 Lee ..... F04B 35/045 417/417
7,934,910 B2 * 5/2011 Park ..... H02K 33/16 417/417
8,109,199 B2 * 2/2012 Kim ..... F04B 35/045 92/140
8,109,740 B2 * 2/2012 Kang ..... F04B 39/023 310/15
8,303,273 B2 * 11/2012 Kang ..... F04B 39/0088 417/416
8,556,599 B2 * 10/2013 Lee ..... F04B 35/045 184/27.4
2003/0147759 A1 8/2003 Chang
2004/0047750 A1 * 3/2004 Kim ..... F04B 39/0016 417/417
2004/0061583 A1 4/2004 Yumita
2004/0109777 A1 * 6/2004 Hur ..... F04B 39/14 417/559
2004/0145248 A1 * 7/2004 Jung ..... H02K 1/27 310/15
2004/0247457 A1 12/2004 Kim et al.
2005/0098031 A1 * 5/2005 Yoon ..... F04B 35/045 92/84
2005/0140216 A1 * 6/2005 Lee ..... F04B 35/045 310/12.26
2005/0142007 A1 * 6/2005 Lee ..... F04B 35/045 417/415
2005/0214140 A1 * 9/2005 Lee ..... F04B 35/045 417/416
2006/0024181 A1 * 2/2006 Kim ..... F04B 35/045 417/417
2006/0060196 A1 3/2006 Kim
2006/0145797 A1 7/2006 Muramatsu et al.
2006/0171825 A1 * 8/2006 Choi ..... F04B 35/045 417/417
2006/0280630 A1 12/2006 Lee et al.
2007/0009370 A1 * 1/2007 Kim ..... F04B 35/045 417/417
2007/0110600 A1 5/2007 Park
2007/0134108 A1 6/2007 Her
2007/0166176 A1 * 7/2007 Kang ..... F04B 35/045 417/417
2008/0000348 A1 1/2008 Schubert et al.
2009/0101003 A1 4/2009 Kim et al.
2010/0021323 A1 1/2010 Schubert
2010/0260627 A1 * 10/2010 Kang ..... F04B 35/045 417/417
2010/0260628 A1 10/2010 Kim
2010/0260629 A1 10/2010 Kang et al.
2010/0266429 A1 10/2010 Kang et al.
2010/0290936 A1 11/2010 Kang et al.
2010/0316513 A1 12/2010 Lee et al.
2011/0194957 A1 8/2011 Kang
2013/0004343 A1 1/2013 Cho et al.
2013/0058815 A1 * 3/2013 Kim ..... F04B 35/045 417/437
2013/0195613 A1 8/2013 Kim

FOREIGN PATENT DOCUMENTS

CN 1862016 11/2006
CN 101133247 2/2008
CN 101835983 9/2010
CN 203770066 8/2014
CN 203835658 9/2014
CN 203867810 10/2014
CN 203906211 10/2014
CN 203906214 10/2014
CN 203978749 12/2014
EP 2 312 157 4/2011
JP 05-240156 A 9/1993
JP 2000-002181 1/2000
JP 2001-158995 A 6/2001
JP 2002-122072 4/2002
JP 2002-138954 A 5/2002
JP 2006-280156 A 10/2006
JP 2007-291991 11/2007
JP 2010-200522 A 9/2010
JP 2013-015092 A 1/2013
KR 10-0792460 1/2008
KR 10-2010-0010421 2/2010
KR 10-2010-0112474 10/2010
KR 10-2013-0118464 A 10/2013
KR 10-2013-0118580 A 10/2013
KR 10-2013-0075512 A 10/2014

(56) References Cited

FOREIGN PATENT DOCUMENTS

| | | | |
|---|---|---|---|
| KR | 10-2013-0075514 | A | 10/2014 |
| WO | WO 02077455 | A1 | 10/2002 |
| WO | WO 2007/046608 | | 4/2007 |
| WO | WO 2012/088571 | | 7/2012 |

OTHER PUBLICATIONS

European Search Report dated Oct. 2, 2015.
European Search Report dated Oct. 14, 2015.
Chinese Office Action date Dec. 28, 2015.
European Search Report issued in Application No. 14169566.8 dated Aug. 10, 2015.
Korean Office Action dated Oct. 13, 2014 issued in Application No. 10-2013-0075512.
Korean Office Action dated Oct. 13, 2014 issued in Application No. 10-2013-0075514.
Chinese Patent Certificate dated Aug. 13, 2014 issued in Application No. 201420160887.6 (patented as Cn 203770066 U).
Chinese Patent Certificate dated Sep. 17, 2014 issued in Application No. 201420187800.4 (patented as CN 203835658 U).
European Search Report dated Nov. 14, 2014 issued in Application No. 14 16 8916.6.
European Search Report dated Sep. 7, 2015.
European Search Report. dated Sep. 25, 2015.
Chinese Office Action dated Dec. 14, 2015.
Chinese Office Action dated Dec. 25, 2015.
Chinese Office Action dated Dec. 28, 2015.
(3)Chinese Office Action dated Dec. 30, 2015.
European Search Report dated Sep. 21, 2015.
Korean Office Action dated Jul. 24, 2014. (0075512).
United States Office Action dated Sep. 8, 2016 issued in U.S. Appl. No. 14/317,336.
United States Office Action dated Sep. 30, 2016 issued in U.S. Appl. No. 14/316,908.
United States Office Action dated Oct. 11, 2016 issued in U.S. Appl. No. 14/280,825.
United States Final Office Action dated Oct. 17, 2016 issued in U.S. Appl. No. 14/317,218.
U.S. Office Action dated Dec. 5, 2016 issued in U.S. Appl. No. 14/317,120.
U.S. Office Action dated Dec. 16, 2016 issued in U.S. Appl. No. 14/317,217.
European Search Report dated Oct. 12, 2016 issued in Application No. 16172236.8.
U.S. Appl. No. 14/280,825, filed May 19, 2014.
U.S. Appl. No. 14/316,908, filed Jun. 27, 2014.
U.S. Appl. No. 14/317,041, filed Jun. 27, 2014.
U.S. Appl. No. 14/317,217, filed Jun. 27, 2014.
U.S. Appl. No. 14/317,218, filed Jun. 27, 2014.
U.S. Appl. No. 14/317,120, filed Jun. 27, 2014.
U.S. Appl. No. 14/317,336, filed Jun. 27, 2014.
Chinese Patent No. 104251196 issued Oct. 5, 2016.
U.S. Office Action issued in U.S. Appl. No. 14/317,217 dated Jun. 15, 2016.
U.S. Office Action issued in U.S. Appl. No. 14/317,218 dated May 20, 2016.
U.S. Office Action issued in U.S. Appl. No. 14/317,120 dated Jun. 2, 2016.
United States Office Action dated Jan. 26, 2017 issued in U.S. Appl. No. 14/317,041.
Chinese Office Action dated Mar. 3, 2017 (English Translation).

* cited by examiner

LINEAR COMPRESSOR

CROSS-REFERENCE TO RELATED APPLICATION(S)

The present application claims priority under 35 U.S.C. 119 and 35 U.S.C. 365 to Korean Patent Application No. 10-2013-0075512, filed in Korea on Jun. 28, 2013, No. 10-2013-0075514, filed in Korea on Jun. 28, 2013, and No. 10-2013-0118581, filed in Korea on Oct. 4, 2013, which are hereby incorporated by reference in their entirety.

BACKGROUND

1. Field

A linear compressor is disclosed herein.

2. Background

In general, compressors may be mechanisms that receive power from power generation devices, such as electric motors or turbines, to compress air, refrigerants, or other working gases, thereby increasing a pressure of the working gas. Compressors are widely used in home appliances or industrial machineries, such as refrigerators and air-conditioners.

Compressors may be largely classified into reciprocating compressors, in which a compression space, into and from which a working gas, such as a refrigerant, is suctioned and discharged, is defined between a piston and a cylinder to compress the refrigerant while the piston is linearly reciprocated within the cylinder; rotary compressors, in which a compression space, into and from which a working fluid, such as a refrigerant, is suctioned and discharged, is defined between a roller, which is eccentrically rotated, and a cylinder to compress the refrigerant while the roller is eccentrically rotated along an inner wall of the cylinder; and scroll compressors, in which a compression space, into and from which a working fluid, such as a refrigerant, is suctioned and discharged, is defined between an orbiting scroll and a fixed scroll to compress the refrigerant while the orbiting scroll, may be rotated along the fixed scroll. In recent years, among reciprocating compressors, linear compressors having a simple structure in which a piston is directly connected to a drive motor, which is linearly reciprocated, to improve compression efficiency without mechanical loss due to switching in moving, are being actively developed. Generally, such a linear compressor is configured to suction and compress a refrigerant while a piston is linearly reciprocated within a cylinder by a linear motor in a sealed shell, thereby discharging the compressed refrigerant.

The linear motor has a structure in which a permanent magnet is disposed between an inner stator and an outer stator. The permanent magnet may be linearly reciprocated by a mutual electromagnetic force between the permanent magnet and the inner (or outer) stator. Also, as the permanent magnet is operated in a state in which the permanent magnet is connected to the piston, the refrigerant may be suctioned and compressed while the piston is linearly reciprocated within the cylinder and then be discharged.

A related art linear compressor is disclosed in Korean Patent Publication No. 10-2010-0010421. The linear compressor according to the related art includes an outer stator, an inner stator, and a permanent magnet which constitute a linear motor. The permanent magnet is connected to an end of a piston.

The permanent magnet is linearly reciprocated by a mutual electromagnetic force between the permanent magnet and the inner and outer stators and. The piston together with the permanent magnet is linearly reciprocated within the cylinder.

According to the related art, while the piston repeatedly moves within the cylinder, an interference between the cylinder and the piston may occur to cause abrasion of the cylinder or piston. More particularly, when a predetermined pressure (a coupling pressure) acts on the piston while the piston is coupled to a peripheral constitution to cause deformation of the piston due to the pressure, the interference between the cylinder and the piston may occur. Also, if a slight error occurs while the piston is assembled with the cylinder, a compression gas may leak to the outside, and thus, abrasion between the cylinder and the piston may occur.

As described above, the interference between the cylinder and the piston may occur causing interference between the permanent magnet and the inner and outer stators, thereby damaging components. Also, in the case of the related art linear compressor, each of the cylinder or the piston may be formed of a magnetic material. Thus, a large amount of flux generated in the linear motor may leak to the outside through the cylinder and piston, deteriorating efficiency in the compressor.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described with reference to the accompanying drawings. Embodiments may, however, be embodied in many different forms and should not be construed as being limited to the embodiments set forth herein; rather, alternate embodiments included in other retrogressive inventions or falling within the spirit and scope of the present disclosure will fully convey the concept of the invention to those skilled in the art.

Figure 1:
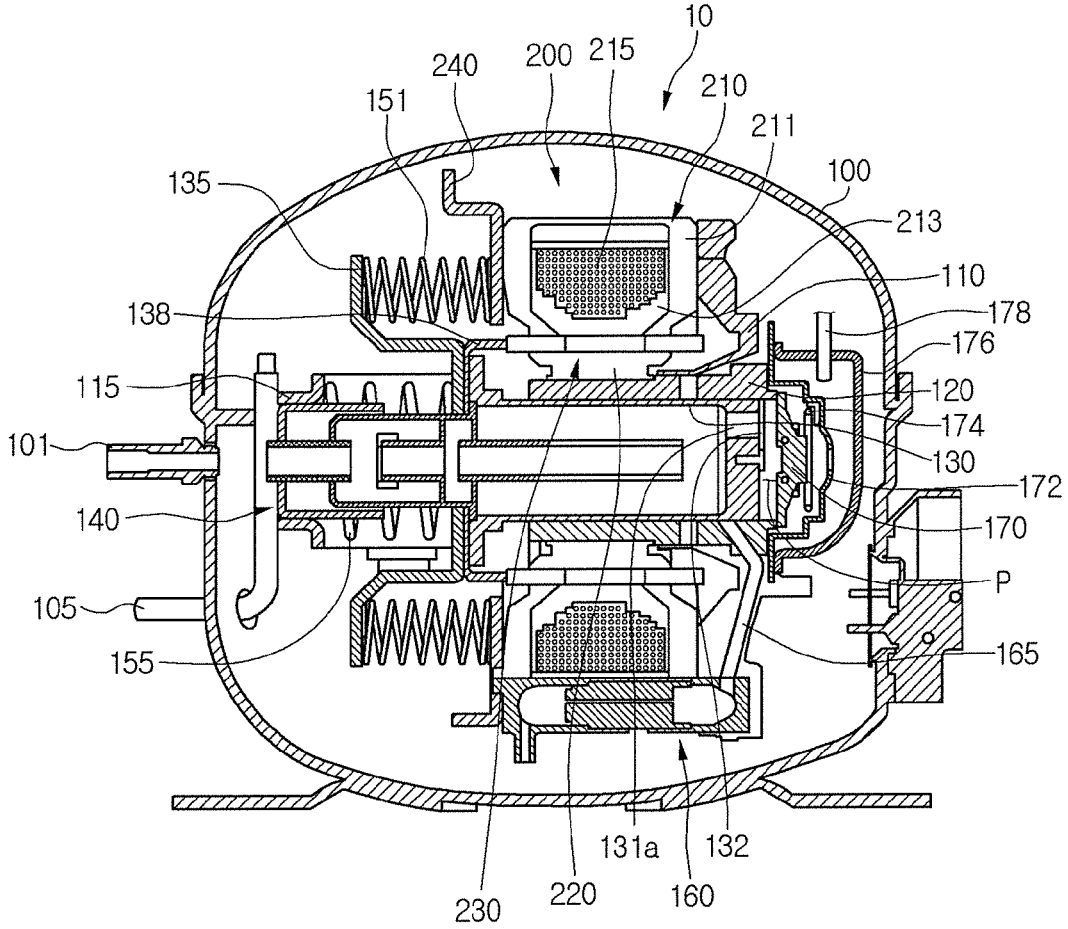
FIG. 1 is a cross-sectional view of a linear compressor according to an embodiment.

FIG. 1 is a cross-sectional view of a linear compressor. Referring to FIG. 1, the linear compressor 10 according to an embodiment may include a cylinder 120 disposed in a shell 100, a piston 130 that linearly reciprocates in the cylinder 120, and a motor assembly 200, which may be a linear motor that exerts a drive force on the piston 130. The shell 100 may include an upper shell to a lower shell.

The cylinder 120 may be made of a non-magnetic material, such as an aluminum-based material, for example, aluminum or aluminum alloy. As the cylinder 120 may be formed of the aluminum-based material, magnetic flux generated in the motor assembly 200 may be transmitted to the cylinder 120, thereby preventing the magnetic flux from leaking to the outside of the cylinder 10. Also, the cylinder 120 may be formed by extruded rod processing, for example.

The piston 130 may be formed of a non-magnetic material, such as an aluminum-based material, for example, aluminum or aluminum alloy. As the piston 130 may be formed of the aluminum-based material, magnetic flux generated in the motor assembly 200 may be delivered to the piston 130, thereby preventing the magnetic flux from leaking to the outside of the piston 130. Also, the piston 130 may be formed by forging, for example.

The cylinder 120 and the piston 130 may have a same material composition ratio, that is, type and composition ratio. The piston 130 and the cylinder 120 may be formed of a same material, for example, aluminum, and thus, have a same thermal expansion coefficient. During operation of the linear compressor 10, a high-temperature environment (about 100° C.) may be created in the shell 100. At this time, the piston 130 and the cylinder 120 may have the same thermal expansion coefficient, and thus, may have the same amount of thermal deformation. As a result, as the piston 130 and the cylinder 120 are thermally deformed in different amounts or directions, it is possible to prevent interference with the cylinder 120 during movement of the piston 130.

The shell 100 may include an inlet 101, through which a refrigerant may be introduced, and an outlet 105, through which the refrigerant compressed in the cylinder 120 may be discharged. The refrigerant suctioned in through the inlet 101 may flow into the piston 130 via a suction muffler 140. While the refrigerant passes through the suction muffler 140, noise may be reduced.

A compression space P to compress the refrigerant by the piston 130 may be defined in the cylinder 120. A suction hole 131*a*, through which the refrigerant may be introduced into the compression space P, may be defined in the piston 130, and a suction valve 132 that selectively opens the suction hole 131*a* may be disposed at a side of the suction hole 131*a*.

A discharge valve assembly 170, 172, and 174 to discharge the refrigerant compressed in the compression space P may be disposed at a side of the compression space P. That is, the compression space P may be formed between an end of the piston 130 and the discharge valve assembly 170, 172, and 174.

The discharge valve assembly 170, 172, and 174 includes a discharge cover 172, in which a discharge space for the refrigerant may be defined; a discharge valve 170, which may be opened and introduce the refrigerant into the discharge space when the pressure of the compression space P is not less than a discharge pressure; and a valve spring 174, which may be disposed between the discharge valve 170 and the discharge cover 172 to exert an elastic force in an axial direction. Herein, the term "axial direction" used herein may refer to a direction in which the piston is linearly reciprocated, that is, a horizontal direction in FIG. 1.

The suction valve 132 may be disposed at a first side of the compression space P, and the discharge valve 170 may be disposed at a second side of the compression space P, that is, at an opposite side of the suction valve 132. While the piston 130 linearly reciprocates inside the cylinder 120, the suction valve 132 may be opened to allow the refrigerant to be introduced into the compression space P when the pressure of the compression space P is lower than the discharge pressure and not greater than a suction pressure. In contrast, when the pressure of the compression space P is not less than the suction pressure, the refrigerant of the compression space P may be compressed in a state in which the suction valve 132 is closed.

If the pressure of the compression space P is the discharge pressure or greater, the valve spring 174 may be deformed to open the discharge valve 170, and the refrigerant may be discharged from the compression space P into the discharge space of the discharge cover 172.

The refrigerant of the discharge space may flow into a loop pipe 178 via a discharge muffler 176. The discharge muffler 176 may reduce flow noise of the compressed refrigerant, and the loop pipe 178 may guide the compressed refrigerant to the outlet 105. The loop pipe 178 may be coupled to the discharge muffler 176 and curvedly extend to be coupled to the outlet 105.

The linear compressor 10 may further include a frame 110. The frame 110, which fix the cylinder 200 within the shell 100, may be integrally formed with the cylinder 200 or may be coupled to the cylinder 120 by means of a separate fastening member, for example. The discharge cover 172 and the discharge muffler 176 may be coupled to the frame 110.

The motor assembly 200 may include an outer stator 210, which may be fixed to the frame 110 and disposed so as to surround the cylinder 120, an inner stator 220 disposed apart from an inside of the outer stator 210, and a permanent magnet 230 disposed in a space between the outer stator 210 and the inner stator 220. The permanent magnet 230 may linearly reciprocate by a mutual electromagnetic force between the outer stator 210 and the inner stator 220.

The permanent magnet 230 may include a single magnet having one pole, or multiple magnets having three poles. More particularly, in the magnet having three poles, if one surface has a distribution of N-S-N poles, an opposite surface may have a distribution of S-N-S poles. Also, the permanent magnet 230 may be formed of a ferrite material, which is relatively inexpensive.

The permanent magnet 230 may be coupled to the piston 130 by a connection member 138. The connection member 138 may extend to the permanent magnet 230 from an end of the piston 130. As the permanent magnet 230 linearly moves, the piston 130 may linearly reciprocate in an axial direction along with the permanent magnet 230.

The outer stator 210 may include a coil 213, a bobbin 215, and a stator core 211. The coil 215 may be wound in a circumferential direction of the bobbin 213. The coil 215 may have a polygonal section, for example, a hexagonal section. The stator core 211 may be provided, such that a plurality of laminations may be stacked in a circumferential direction, and may be disposed to surround the bobbin 213 and coil 215.

When current is applied to the motor assembly 200, the current may flow into the coil 215, and the magnetic flux may flow around the coil 215 due to the current flowing into the coil 215. The magnetic flux may flow to form a close circuit along the outer stator 210 and the inner stator 220. The magnetic flux flowing along the outer stator 210 and the inner stator 220 and the magnetic flux of the permanent magnet 230 may mutually act on each other to generate a force to move the permanent magnet 230.

A stator cover 240 may be disposed at a side of the outer stator 210. A first end of the outer stator 210 may be supported by the frame 110, and a second end thereof may be supported by the stator cover 240.

The inner stator 220 may be fixed to an outer circumference of the cylinder 120. The inner stator 220 may be configured, such that a plurality of laminations may be stacked at an outer side of the cylinder 120 in a circumferential direction.

The linear compressor 10 may further include a supporter 135 that supports the piston 130, and a back cover 115 that extends toward the inlet 101 from the piston 130. The back cover 115 may be disposed to cover at least a portion of the suction muffler 140.

The linear compressor 10 may further include a plurality of springs 151 and 155, a natural frequency of which each may be adjusted so as to allow the piston 130 to perform resonant motion. The plurality of springs 151 and 155 may be elastic members.

The plurality of springs 151 and 155 may include a plurality of first spring 151 supported between the supporter 135 and the stator cover 240, and a plurality of second spring 155 supported between the supporter 135 and the back cover 115. The first and the second springs 151 and 155 may have a same elastic coefficient.

The plurality of first springs 151 may be provided at upper and lower sides of the cylinder 120 or piston 130, and the plurality of second springs 155 may be provided at a front of the cylinder 120 or piston 130. Herein, the term "front" used herein may refer to a direction oriented toward the inlet 101 from the piston 130. The term "rear" may refer to a direction oriented toward the discharge valve assembly 170, 172, and 174 from the inlet 101. These terms may be equally used in the following description.

A predetermined amount of oil may be stored on or at an inner bottom surface of the shell 100. An oil supply device 160 to pump the oil may be provided in a lower portion of the shell 100. The oil supply device 160 may be operated by vibration generated according to linear reciprocating motion of the piston 130 to thereby pump the oil upward.

The linear compressor 10 may further include an oil supply pipe 165 to guide the flow of the oil from the oil supply device 160. The oil supply pipe 165 may extend from the oil supply device 160 to a space between the cylinder 120 and the piston 130. The oil pumped from the oil supply device 160 may be supplied to the space between the cylinder 120 and the piston 130 via the oil supply pipe 165, and perform cooling and lubricating operations.

Figure 2:
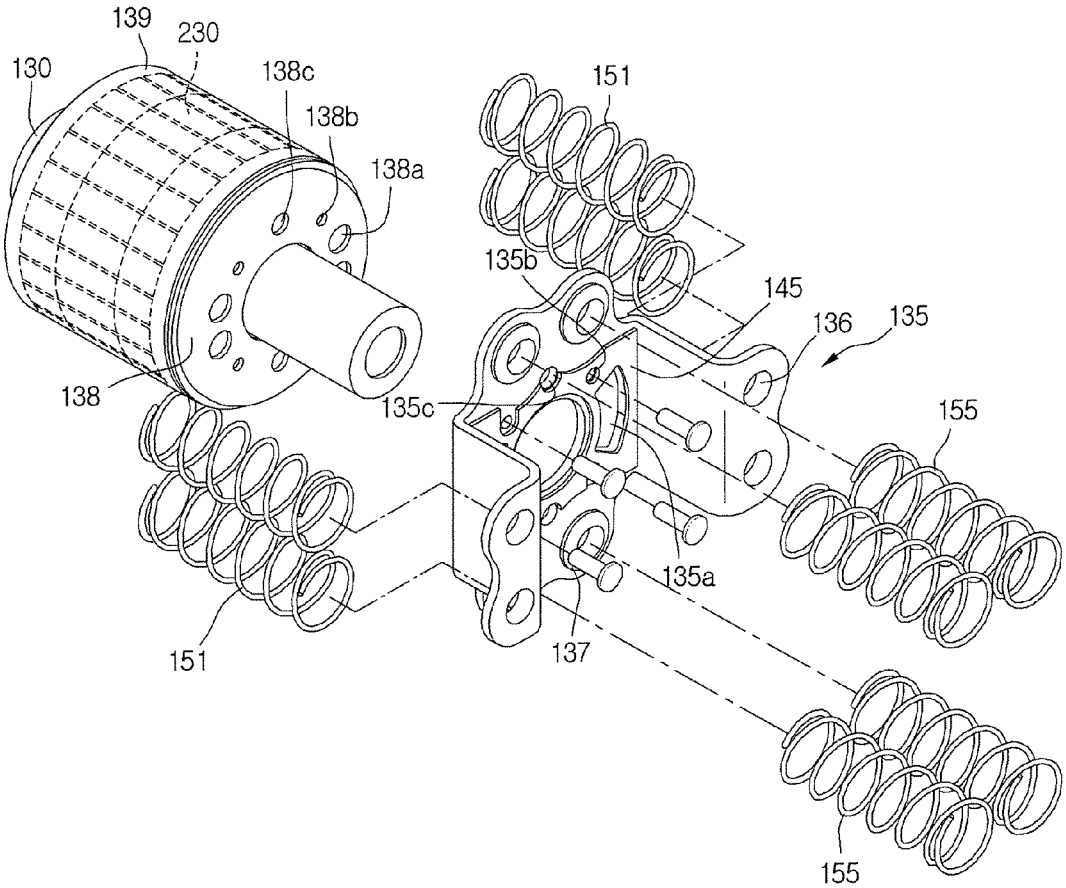
FIG. 2 is an exploded perspective view of a drive device of the linear compressor of FIG. 1 according to an embodiment.
Figure 3:
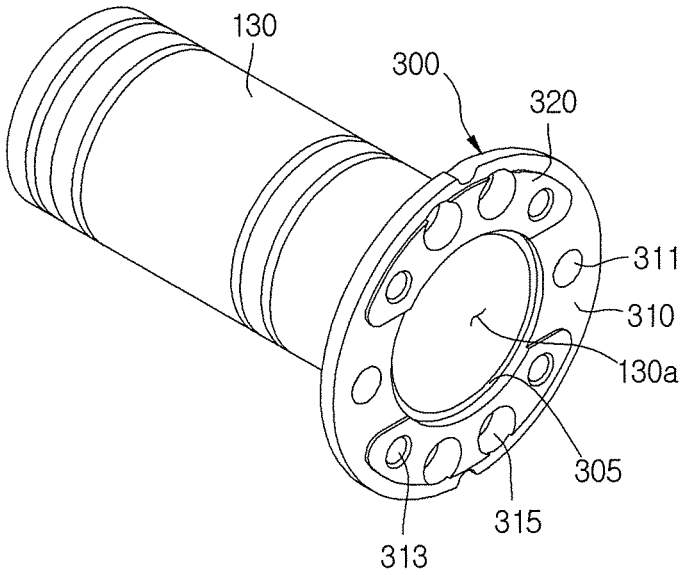
FIGS. 3 to 5 are views of a piston assembly according to an embodiment.
Figure 4:
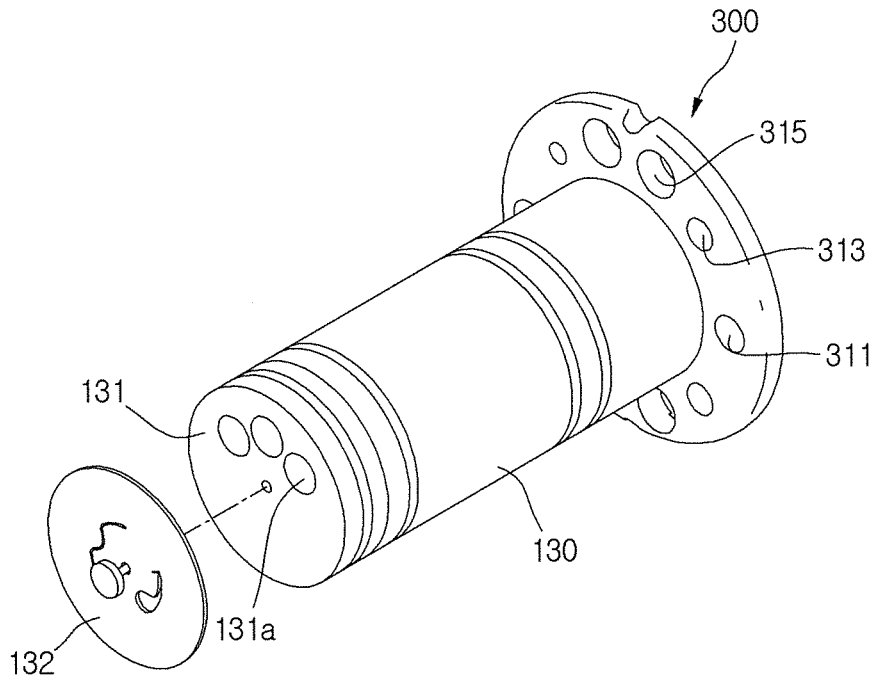
Figure 5:
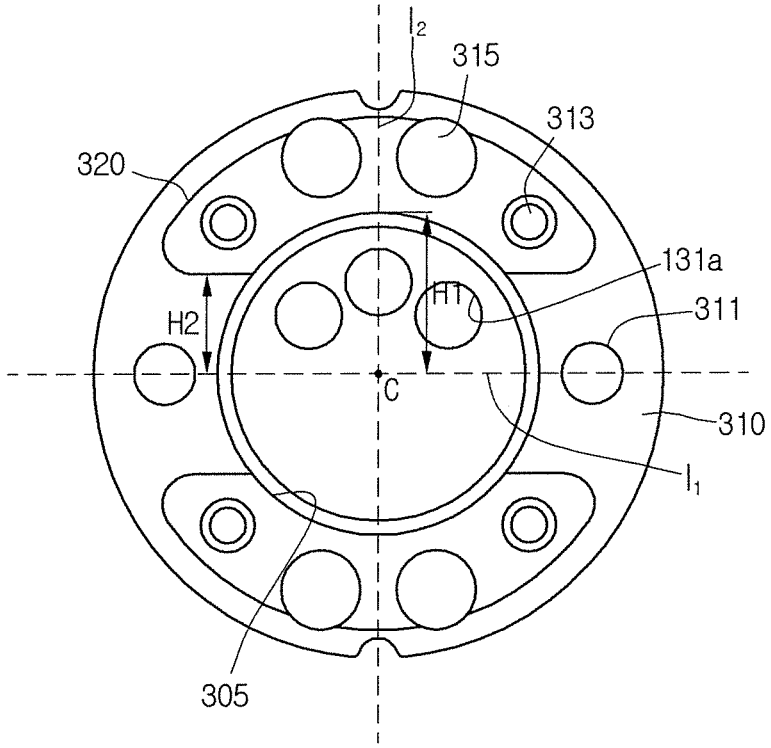
Figure 6:
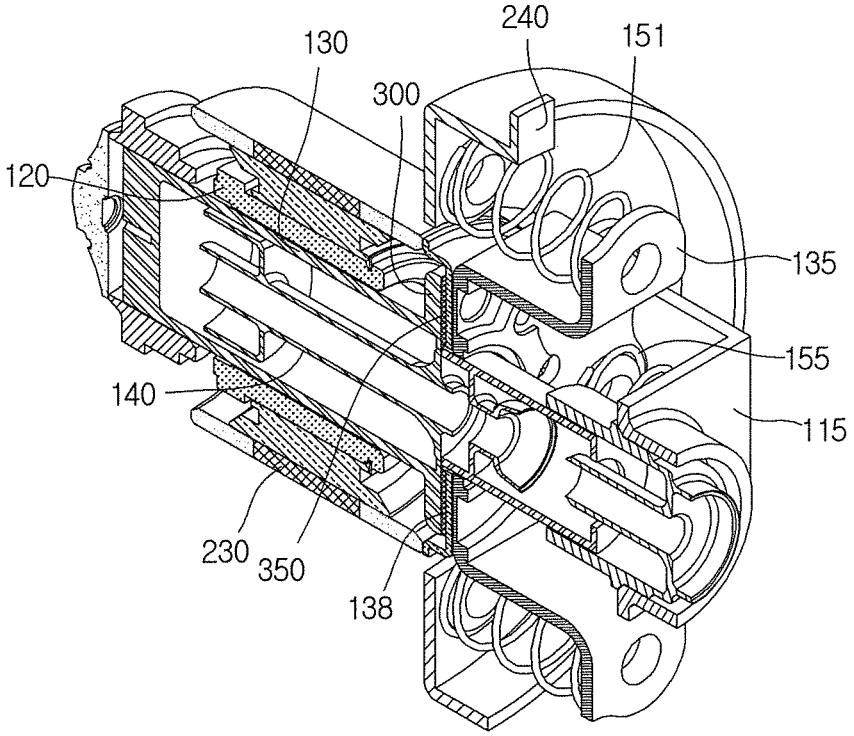
FIG. 6 is a partial cross-sectional view illustrating main components of the linear compressor of FIG. 1.
Figure 7:
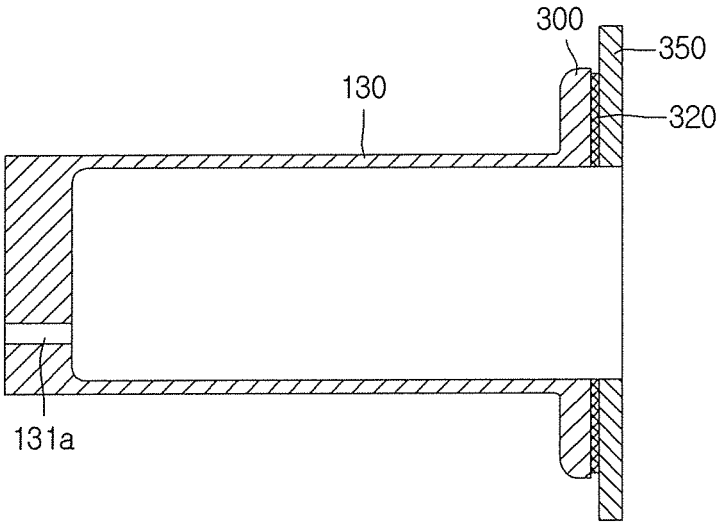
FIG. 7 is a cross-sectional view of a coupled state between the piston assembly and a supporter according to an embodiment.

FIG. 2 is an exploded perspective view of a drive device of the linear compressor of FIG. 1 according to an embodiment. FIGS. 3 to 5 are views of a piston assembly according to an embodiment. FIG. 6 is a partial cross-sectional view illustrating main components of the linear compressor according to an embodiment, FIG. 7 is a cross-sectional view of a coupled state between the piston assembly and a support according to an embodiment.

Referring to FIGS. 2 to 7, a drive device of the linear compressor according to an embodiment may include the piston 130, which is capable of being reciprocated within the cylinder 120, the connection member 138, which extends from an end of the piston 130 toward the permanent magnet 230, and the permanent magnet 230, which is coupled to an end of the connection member 138. Also, the drive device may include a taping member 139 that surrounds an outside of the permanent magnet 230. The taping member 139 may be manufactured by mixing a glass fiber with a resin. The taping member 139 may firmly maintain the coupled state between the permanent magnet 230 and the connection member 138.

A piston guide (see reference numeral 350 of FIG. 6) coupled to a flange (see reference numeral 300 of FIG. 3) of the piston 130 may be provided inside the connection member 138. The piston guide 350 may be inserted between the flange 300 and an inner surface of the connection member 138.

The piston guide 350 may support the flange 300 of the piston 130 to reduce a load acting on the piston 130 or the flange 330. The piston and the flange 330 may be referred to as a "piston assembly".

The supporter 135, which may movably support the piston assembly, may be provided outside the connection member 138, that is, at a front side of the connection member 138. The supporter 135 may be elastically supported inside the linear compressor 10 by the plurality of springs 151 and 155.

The supporter 135 may include a plurality of spring seats 136 and 137, to which the plurality of springs 151 and 155 may be coupled. In more detail, the plurality of spring seats 136 and 136 may include a plurality of first spring seats 136, on which an end of the first springs 151 may be seated. The plurality of first spring seats 136 may be provided on upper and lower portions of the support 135, respectively.

For example, two first spring seats 136 may be provided on the upper portion of the supporter 135, and two first spring seats 136 may be provided on the lower portion of the supporter 135. Thus, one end of each of the two first springs 151 may be coupled to the upper portion of the supporter 135, and one end of each of the other two first springs 151 may be coupled to the lower portion of the supporter 135.

Also, the other end of each of the four first springs 151 may be coupled to the stator cover 240 provided above and below the supporter 135. A force or load may be applied to the supporter 135 from the stator cover 240 by the plurality of first springs 151 (see FIG. 9A).

The plurality of spring seats 136 and 137 may further include a plurality of second spring seats 137, on which an end of the plurality of second springs 155 may be seated. The plurality of second spring seats 137 may be provided on left and right portions of the supporter 135, respectively.

For example, two second spring seats 137 may be provided on a left portion of the supporter 135, and two second spring seats 137 may be provided on a right portion of the supporter 135. Thus, one end of each of the two second springs 155 may be coupled to the left portion of the supporter 135, and one end of each of the other two second springs 155 may be coupled to the right portion of the supporter 135.

Also, the other end of each of the four second springs 155 may be coupled to the back cover 115 provided at a front side of the piston 130. A force or load may be applied to the supporter 135 backward from the back cover 115 by the plurality of second springs 155. As the plurality of first and second springs 151 and 155 may have a same elastic coefficient, a force acting due the four second springs 155 may be similar to that acting due to the four first springs 151 (see FIG. 9A). A first virtual line that extends from a center of the supporter 135 toward a direction (the upper or lower portion) facing the first spring seats 136 and a second virtual line that extends from the center of the supporter 135 toward a direction (the left or right portion) facing the second spring seats 137 may be approximately perpendicular to each other.

A plurality of coupling holes 135*b* and 135*c*, to which a coupling member may be coupled, may be defined in the supporter 135. The plurality of coupling holes 135*b* and 135*c* may include a plurality of support coupling holes 135*b* and a plurality of support assembly holes 135*c*. The plurality of support coupling holes 135*b* may be defined in the upper and lower portions of the supporter 135, and the plurality of support assembly holes 135*c* may be defined in the left and right portions of the supporter 135.

For example, two support holes 135*b* may be defined in each of the upper and lower portions of the supporter 135, and one support assembly hole 135*c* may be defined in each of the left and right portions of the supporter 135. Also, the support coupling holes 135*b* and the support assembly holes 135*c* may have sizes different from each other.

Coupling holes corresponding to the plurality of holes 135*b* and 135*c* may be defined in the connection member 138, the piston guide 350, and the flange 300 of the piston assembly, respectively. A coupling member 157 may pass through the coupling holes to couple the connection member 138, the piston guide 350, and the flange 300 to each other.

For example, connection member coupling holes 138*b* and connection member assembly holes 138*c*, which respectively correspond to the support coupling holes 135*b* and the support assembly holes 135*c*, may be defined in the connection member 138.

The flange 300 may have a property that it is deformed in a predetermined direction by acting on the coupling load or pressure during the coupling process using the coupling member 157. More particularly, the flange 300 may be formed of an aluminum material having a soft property that is, the flange 300 may be made of an aluminum material which is relatively soft in comparison to the other components. Thus, a deformed degree of the flange 300 may increase. Descriptions relating to the above-described structure will be discussed hereinbelow.

Support communication holes 135*a* to reduce resistance in gas flow existing within the linear compressor 10 may be defined in the support 135. The support communication holes 135*a* may be formed by cutting at least a portion of the support 135 and may be defined in the upper and lower portions of the support 135, respectively.

Also, communication holes corresponding to the support communication holes 135*a* may be defined in the connection member 138, the piston guide 350, and the flange 300 of the piston assembly, respectively. For example, connection member communication holes 138*a* corresponding to the support communication holes 135*a* may be defined in the connection member 138. A gas may flow through the communication holes, which may be defined in the connection member 138, the piston guide 350, the flange 300, and the support 135 to reduce gas flow resistance.

The drive device may include a balance weight 145, which may be coupled to the supporter 135, to reduce vibration generated during operation of the drive device. The balance weight 145 may be coupled to a front surface of the supporter 135.

A plurality of weight coupling holes corresponding to the support coupling holes 135*b* and a plurality of weight communication holes corresponding to the support communication holes 135*a* may be defined in the balance weight 145. The balance weight 145 may be coupled to the supporter 135, the connection member 138, and the flange 300 of the piston 130 by the coupling member 157.

The drive device may further include the suction muffler 140 to reduce flow noise of the refrigerant. The suction muffler 140 may pass through the support 135, the balance weight 145, the connection member 138, and the flange 300 of the piston 130 to extend into the cylinder 120. Also, at least one portion of the suction muffler 140 may be inserted between the flange 300 and the piston guide 350, and thus, fixed in position (see FIG. 6).

Hereinafter, components of the piston assembly 130 and 300 will be described with reference to FIG. 3.

The piston assembly may include the piston 130, which is capable of being reciprocated within the cylinder 120, and the flange 300, which may extend from an end of the piston 130 in a radial direction.

The piston 130 may have a hollow cylindrical shape. A flow space 130*a*, in which the refrigerant may flow, may be defined in the piston 130. The refrigerant introduced into the linear compressor 10 through the inlet 101 may flow into the flow space 130*a* via the suction muffler 140.

The piston 130 may have a surface that face the compression space P, that is, a compression surface 131. The compression surface 131 may be understood as a surface that defines the compression space P. The suction hole 131*a* to suction the refrigerant into the compression space P may be defined in the compression surface 131.

The suction valve 132 may be coupled to the compression surface 131 of the piston 130. The suction valve 132 may be coupled to the compression surface 131 to selectively open the suction hole 131*a*.

The flange 300 may include a coupling surface 310 coupled to the piston guide 350, and one or more reinforcing ribs 320 coupled to the coupling surface 310 to guide deformation of the flange 300. The coupling surface 310 may form a flat surface. An opening 305 that communicates with the flow space 130*a* may be defined inside the coupling surface 310. The opening 305 may be understood as or referred to as an "inlet" to introduce the refrigerant into the flow space 130*a*. The opening 305 may have an approximately circular shape to correspond to an outer appearance of the piston 130.

A plurality of coupling holes 311 and 313 to be coupled by the coupling member 157 may be defined in the flange 300. The plurality of holes 311 and 313 may include a plurality of flange assembly holes 311 and a plurality of flange coupling holes 313.

The plurality of flange assembly holes 311 may be defined in positions corresponding to those of the support assembly holes 135*c* of the supporter 135. The plurality of flange coupling hole 313 may be defined in positions corresponding to those of the support coupling holes 135*b* of the supporter 135. That is, the flange assembly holes 311 may be defined in left and right portions of the flange 300, and the flange coupling holes 313 may be defined in upper and lower portions of the flange 300. For example, one flange assembly hole 311 may be defined in each of the left and right portions, and two flange coupling holes 313 may be defined in each of the upper and lower portions.

A plurality of flange communication holes 315 may be defined in the flange 300. The plurality of flange communication holes 315 may be defined in positions corresponding to the support communication holes 135*a*, that is, in the upper and lower portions of the flange 200. For example, the two flange communication holes 315 may be defined in each of the upper and lower portions.

The one or more reinforcing ribs 320 may protrude from the coupling surface 310, which may be flat, in a direction of the supporter 135 or the piston guide 350 (see FIG. 7). That is, the one or more reinforcing ribs 320 may be inserted between the coupling surface 310 of the flange 300 and the supporter 135. The one or more reinforcing ribs 320 may be provided on only a portion of the coupling surface 310. Further, the one or more reinforcing ribs 320 may each be in the form of a reinforcing plate.

In more detail, the one or more reinforcing ribs 320 may be provided on each of upper and lower portions of the coupling surface 310. The upper and lower portions of the coupling surface 310 may correspond to the upper and lower portions of the supporter 135. That is, the one or more reinforcing ribs 320 may be disposed to cover portions of areas defining the upper and lower portions with respect to a whole area of the coupling surface 310.

For example, the one or more reinforcing ribs 320 may be provided on the upper and lower portions of the coupling surface 310, in which the flange coupling holes 313 and the flange communication holes 315 are defined. That is, the one or more reinforcing ribs 320 may be provided on an area in which the flange coupling holes 313 are defined.

On the other hand, the one or more reinforcing ribs 320 may not be provided on the left and right portions of the coupling surface 310, in which the flange assembly holes 311 are defined. A portion of the flange 300 on which the one or more reinforcing ribs 320 is provided may have a strength greater than a strength of a portion on which the one or more reinforcing ribs 320 is not provided.

Thus, a plurality of reinforcing ribs 320 may be provided, and the plurality of reinforcing ribs 320 may be spaced apart from each other. Also, the plurality of reinforcing ribs 320 may be symmetrically disposed with respect to a center of the flange 300, that is, a center of the opening 305.

In more detail, referring to FIG. 5, a virtual first extension line l1 that extends from a center C of the opening 305 to left and right portions of the flange 300 and a second extension line l2 that extends to upper and lower portions of the flange 300 may be disposed to cross each other. The plurality of reinforcing ribs 320 may be symmetrically disposed on both sides with respect to the first extension line l1. Also, the plurality of reinforcing ribs 320 may be spaced apart from the first extension line l1.

The first extension line l1 may be disposed to pass through the flange assembly hole 311, and the second extension line l2 may be disposed to equally divide the plurality of reinforcing ribs 320. The reinforcing ribs 320 may be divided into a same area by the second extension line l2. The second extension line l2 may pass through a space between the plurality of flange coupling holes 313 and then pass through a space between the plurality of flange communication holes 315.

A shortest distance H2 from the first extension line l1 to the reinforcing rib 320 may be greater than a distance H1 from the center of the opening 305 to the reinforcing rib 320.

When the flange 300 is coupled to the piston guide 350, the connection member 138, and the support 135, a load or pressure due to the coupling of the flange 300 may act on the coupling surface 310. Thus, the coupling surface 310 may be deformed.

More particularly, as the portion of the flange 300, on which the reinforcing rib 320 is not provided, may be relatively weak when compared to the portion on which the reinforcing rib 320 is provided, the relatively weak portion may be further deformed. For example, referring to FIG. 5, the flange 300 may be deformed to extend in a horizontal direction, that is, may be flat or flattened in the horizontal direction (see FIG. 8B).

Hereinafter, deformation of the flange 300 according to an assembly process of the linear compressor 10 will be described.

Figure 8A:
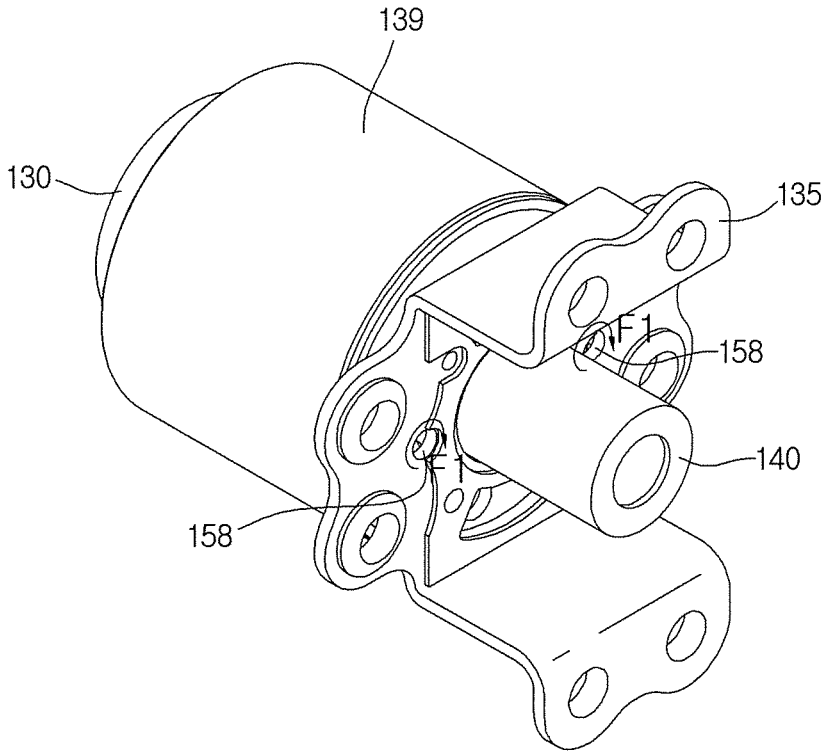
FIG. 8A is a view illustrating a force that acts when the piston assembly and the supporter are coupled to each other according to an embodiment.
Figure 8B:
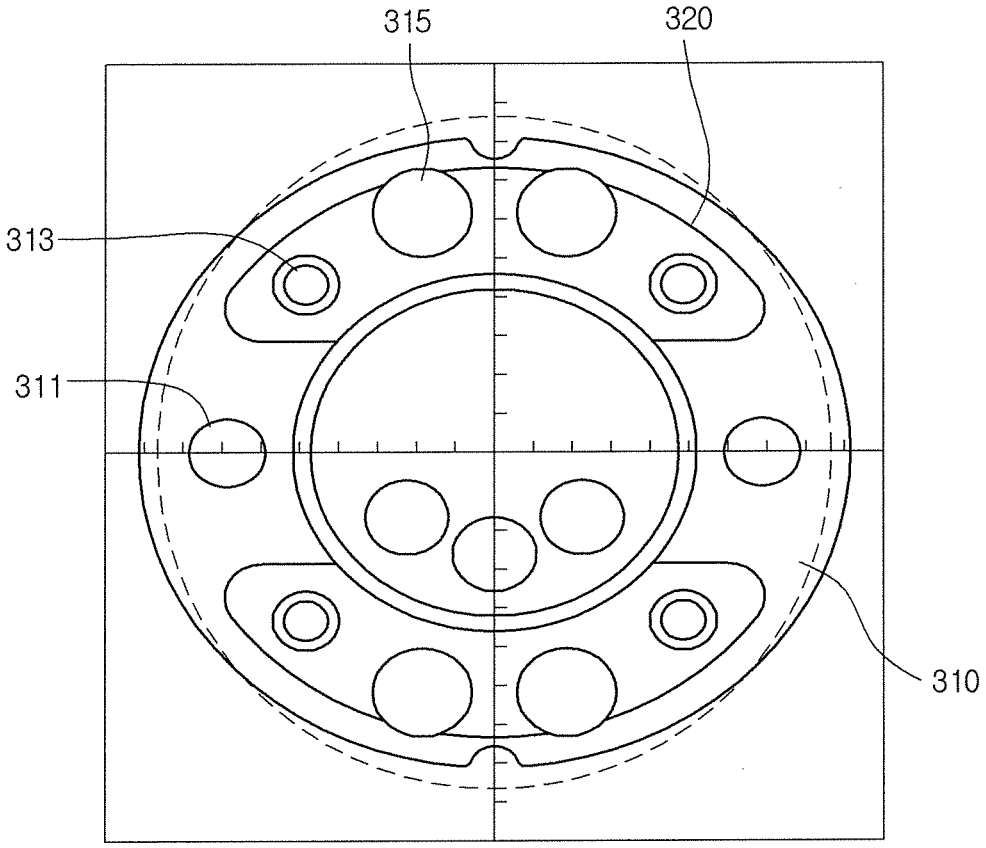
FIG. 8B is a view illustrating deformation in a flange of the piston assembly during the coupling process in FIG. 8A.

FIG. 8A is a view illustrating a force acting when the piston assembly and the supporter are coupled to each other according to an embodiment. FIG. 8B is a view illustrating deformation in the flange of the piston assembly during the coupling process in FIG. 8A.

Referring to FIGS. 6 and 8A, in a state in which the piston 130 according to an embodiment is accommodated in the cylinder 120, the piston guide 350 may be disposed on the coupling surface 310 of the flange 300. Also, the suction muffler 140 may be supported by the flange 300 and the piston guide 350 may extend into the piston 130.

The cylinder 120, the piston 130, the flange 300, and the piston guide 350 may be disposed inside the connection member 138 coupled to the permanent magnet 230. The coupling surface 310 of the flange 300 may be coupled to a first side of the piston guide 350, and an inner surface of the connection member 138 may be coupled to a second side of the piston guide 350. Also, the supporter 135 may be disposed on an outer surface of the connection member 157, and the coupling member 158 may be coupled to the supporter 135.

The coupling member 157 may pass through the supporter 135, the connection member 138, the piston guide 350, and the coupling holes and assembly holes defined in the flange 300 to fix the supporter 135, the connection member 138, the piston guide 350, and the flange 300 at the same time. The assembly of the supporter 135, the connection member 138, the piston guide 350, and the flange 300, which may be fixed at the same time, may be called a drive assembly.

The flange 300 may be deformed by a coupling force F1 of the coupling member 157. More particularly, the flange 300 may be horizontally deformed in a flat shape by the reinforcing rib 320.

In more detail, referring to FIG. 8B, the first extension line l1 may be defined as a line that extends in a horizontal direction so that a right end thereof is disposed at an angle of about 0°, and a left end thereof is disposed at an angle of about 180°. Also, the second extension line l2 may be defined as a line that extends in a vertical direction so that an upper end thereof is disposed at an angle of about 90°, and a lower end thereof is disposed at an angle of about 270°.

The flange 300 may be further deformed at the coupling surface 310 on which the reinforcing rib 320 is not provided, while the flange 300 is coupled to the supporter 135. That is, when compared to an original shape (approximately circular dotted lines) of the flange 300, the flange 300 may be deformed into a flat oval shape, upper and lower sides of which decrease in length, and left and right sides increase in length.

Figure 9A:
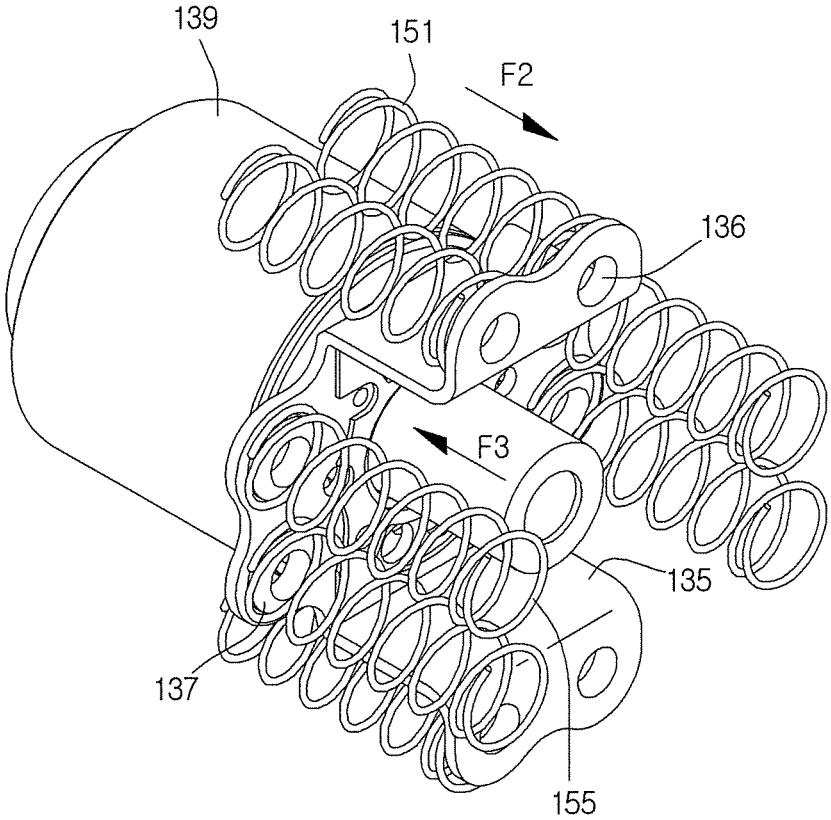
FIG. 9A is a view illustrating a force that acts when a spring is coupled to the supporter according to an embodiment.
Figure 9B:
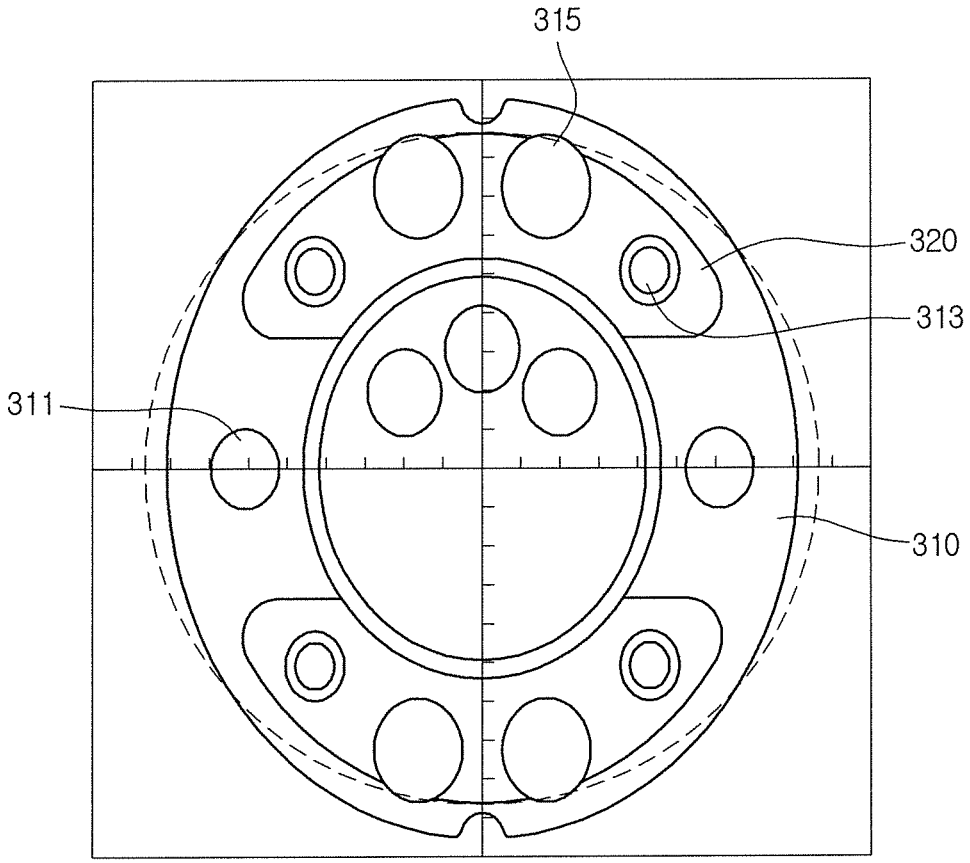
FIG. 9B is a view illustrating deformation in the flange of the piston assembly during the coupling process in FIG. 9A.

FIG. 9A is a view illustrating a force that acts when the spring is coupled to the supporter according to an embodiment. FIG. 9B is a view illustrating deformation in the flange of the piston assembly during the coupling process in FIG. 9A.

Referring to FIGS. 6 and 9A, the first and second springs 151 and 155 may be coupled to the drive assembly. That is, the plurality of first springs 151 may be coupled between the supporter 135 and the stator cover 240, and the plurality of second springs 155 may be coupled between the supporter 135 and the back cover 115. The plurality of first springs 151 may be supported by the upper and lower portions of the supporter 135, and the plurality of second springs 155 may be supported by the left and right portions of the supporter 135.

The upper portion of the supporter 135, to which the plurality of first springs 151 may be coupled, may be called a "first side portion", and the lower portion may be called a "second side portion". Also, the left portion of the supporter 135, to which the plurality of second springs 155 may be coupled may be called a "third side portion", and the right portion may be called a "fourth side portion". A virtual line that connects the first side portion to the second side portion may perpendicularly cross a virtual line that connects the third side portion to the fourth side portion. The reinforcing rib 320 may be disposed at positions of the flange 300 corresponding to the first and second side portions, that is, the upper and lower portions of the flange 300.

When the plurality of first springs 151 is coupled to the supporter 135, a force F2 may act from the stator cover 240 to the supporter 135, that is, in a first or forward direction. Also, when the plurality of second springs 155 is coupled to the supporter 135, a force F3 may act from the back cover 115 to the supporter 135, that is, in a second or backward direction.

Combining the force F3 with the force F4, a force may act forward on the upper and lower portions of the supporter 135 by the plurality of first springs 151, and a force may act backward on the left and right portions of the supporter 135 by the plurality of second springs 155. That is, the direction of the force due to the plurality of first springs 151 and the direction of the force due to the plurality of second springs 155 may be opposite to each other.

As a result, the forward force may act on the upper and lower portions of the flange 300 coupled to the supporter 135, and the backward force may act on the left and right portions of the flange 300. Due to the action of the combined forces, the flange 300 may be deformed in the vertical direction.

In more detail, referring to FIG. 9B, when the plurality of first and second springs 151 and 155 are coupled to the supporter 135, the flange 300 may be deformed in a long oval shape, that is, shortened in length at left and right sides and extended in length at upper and lower sides by the elastic force of the springs that act forward and backward when compared to the original shape of the flange 300.

Figure 10:
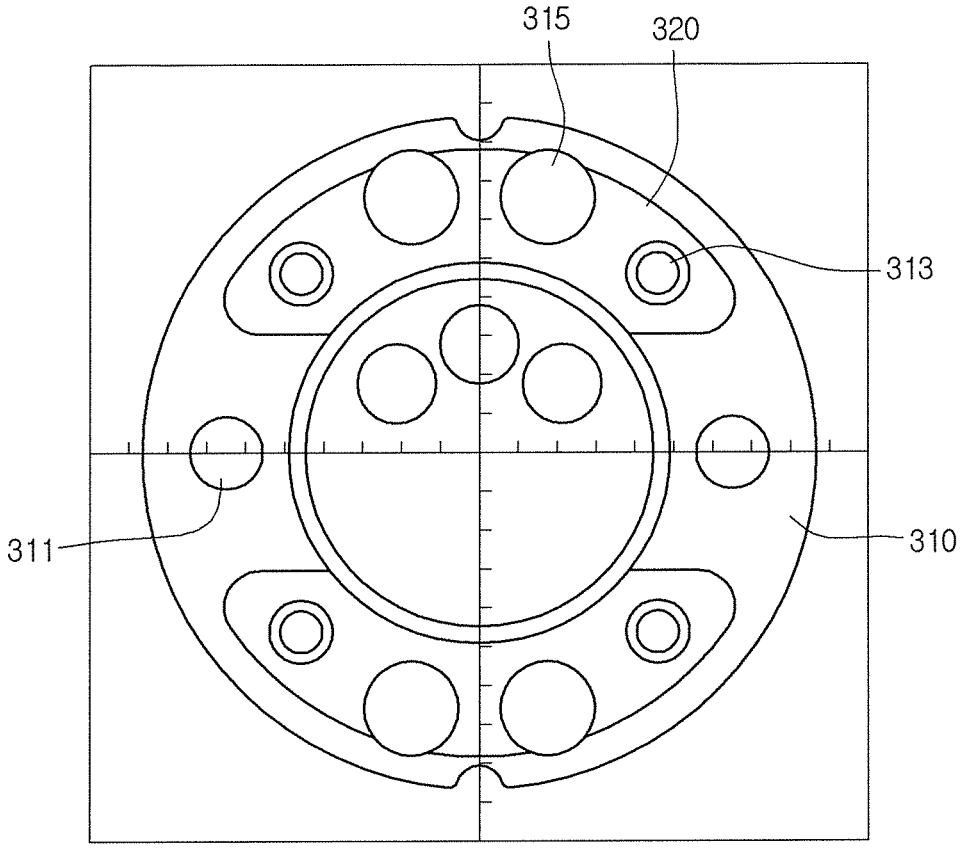
FIG. 10 is a view illustrating a configuration of the flange of the piston assembly after the coupling in FIGS. 8A and 9A is completed.

FIG. 10 is a view illustrating a configuration of the flange of the piston assembly after the coupling in FIGS. 8A and 9A is completed. That is, FIG. 10 illustrates a state of the flange 300 according to the result obtained by combining the deformed shapes of the flange 300 in FIGS. 8B and 9B after the coupling process described with reference to FIGS. 8A and 9A is completed.

In more detail, while the piston guide 350, the connection member 138, the supporter 135 are coupled to the flange 300, the flange 300 may be deformed in a horizontally flat oval shape (first deformation). Thereafter, as the flange 300 is deformed in a vertically extending oval shape while the first and second springs 151 and 155 are coupled to the supporter 135, the first and second deformations may be combined with each other to form an approximately circular shape of the flange 300 after the assembly process is completed.

In summary, when the flange 300 and the supporter 135 are primarily coupled to each other, the flange 300 may be deformed in a flat shape in a first direction. Also, when the supporter 135 and the plurality of springs 151 and 155 are secondarily coupled to each other, the force may act on the flange 300 so that the flange 300 is flattened in a second direction. Thus, the flange 300 may be deformed to return to its original shape. Here, the term "second direction" may refer to a direction opposite to the first direction.

As described above, as deformation of the flange 300 may be prevented after the piston assembly and peripheral components are assembled, the piston may be prevented from being deformed, and thus, abrasion of the cylinder or the piston due to reciprocating motion of the piston may be reduced.

Although the refrigerant may be provided into the compression space via the space within the piston in the linear compressor according to embodiments, embodiments are not limited thereto. If the refrigerant is smoothly supplied into the compression space, embodiments are not limited to the above-described structure. For example, the compressed refrigerant may be directly supplied into the compression space through the refrigerant suction-side, that is, disposed at a same position as the refrigerant discharge-side to discharge the compressed refrigerant without passing through the inner space of the piston, like existing linear compressors.

According to embodiments, as the reinforcing rib is provided on the flange of the piston, deformation of the flange may be induced in one direction while the flange is primarily coupled to the support. Also, as the flange is deformed in the other direction while the elastic member is secondarily coupled to the support, deformations may be offset to prevent the flange from being deformed after primary and secondary couplings are completed.

As deformation of the flange may be prevented, pressure (the coupling pressure) acting on the piston may be reduced to prevent the piston from being deformed. As a result, interference between the cylinder and the piston while the piston is reciprocated may be reduced, and thus, abrasion of the cylinder or piston may be reduced.

Also, as each of the cylinder and the piston is formed of non-magnetic material, that is, an aluminum material to prevent flux generated in the motor assembly from leaking to the outside of the cylinder, efficiency of the compressor may be improved. Also, the permanent magnet provided in the motor assembly may be formed of a ferrite material to reduce manufacturing costs of the compressor.

Embodiments disclosed herein provide a linear compressor in which deformation of a piston may be prevented.

Embodiments disclosed herein a linear compressor that may include a shell including a refrigerant suction port or inlet, a cylinder provided within the shell, a piston reciprocated within the cylinder, the piston having a flow space in which a refrigerant may flow, a motor assembly that exerts a drive force, the motor assembly including a permanent magnet, a flange part or flange that extends from an end of the piston in a radial direction, the flange part having an opening that communicates with the flow space of the piston and a coupling hole defined outside the opening, a supporter coupled to the coupling surface of the flange part to support a plurality of springs, and a reinforcing member or rib that protrudes from the coupling surface to guide deformation of the flange part while the flange part and the supporter are coupled to each other. The reinforcing member may be provided in plurality.

A virtual extension line that crosses a center of the opening may be defined, and the plurality of reinforcing members may be spaced apart from the center of the opening and disposed outside the opening. The plurality of reinforcing members may be symmetrically disposed with respect to the center of the opening.

A virtual first extension line that passes through the center of the opening and a virtual second extension line that extends in a direction substantially perpendicular to a direction of the first extension line may be defined, and a shortest distance H2 from the first extension line to the reinforcing member may be less than a distance H1 from the center of the opening to the reinforcing member on the second extension line.

A plurality of coupling holes coupled to coupling holes of the supporter by the coupling member may be defined in the flange part, and the reinforcing member may be disposed on an area that covers the plurality of coupling holes.

A support communication hole to guide a flow of a refrigerant gas existing in the shall may be defined in the support, and a flange communication hole coupled to the support communication hole may be defined in the flange part. The reinforcing member may be disposed on an area that covers the flange communication hole.

The plurality of springs may include a plurality of first springs provided on upper and lower portions of the supporter, and a plurality of second springs provided on left and right portions of the supporter.

The linear compressor may further include a stator cover provided on one side of the supporter, the stator cover being coupled to the plurality of first springs, and a back cover provided on the other side of the supporter. The back cover may be coupled to the plurality of second springs.

A direction of a force that acts from the stator cover by the plurality of first springs and a direction of a force that acts from the back cover may be opposite to each other.

The reinforcing member may be disposed on an upper portion of the coupling surface corresponding to the upper portion of the supporter or a lower portion of the coupling surface corresponding to the lower portion of the supporter.

The linear compressor may further include a connection member coupled to the permanent magnet, and a piston guide disposed between an inner surface of the connection member and the flange part to reduce vibration of the piston. The flange part, the supporter, the connection member, and the piston guide may be coupled to each other at a same time by the coupling member. The reinforcing member may be disposed to contact the piston guide.

Each of the piston and the cylinder may be formed of aluminum or an aluminum alloy. The reinforcing member may be integrated with the flange part.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a shell;

a cylinder provided within the shell;

a piston reciprocated within the cylinder;

a motor assembly that provides a drive force to the piston, the motor assembly including a permanent magnet;

a flange that extends from an end of the piston in a radial direction, the flange having a coupling surface;

a supporter coupled to the coupling surface of the flange;

at least one spring supported by the supporter;

a connection member coupled to the permanent magnet and the supporter;

a piston guide provided between an inner surface of the connection member and the flange; and at least one reinforcing rib interposed between the coupling surface of the flange and the supporter, wherein the at least one reinforcing rib protrudes from the coupling surface towards the piston guide, to guide deformation due to coupling of the flange with the supporter, and wherein the at least one reinforcing rib includes a plurality of reinforcing ribs.

2. The linear compressor according to claim 1, wherein the plurality of reinforcing ribs is provided at a position to guide deformation of the flange in a first direction when the flange and the supporter are coupled to each other.

3. The linear compressor according to claim 1, further including an opening defined in the coupling surface to communicate with a flow space of the piston, wherein the plurality of reinforcing ribs is spaced apart from a center of the opening and provided outside of the opening.

4. The linear compressor according to claim 3, wherein the plurality of reinforcing ribs is symmetrically provided with respect to the center of the opening.

5. The linear compressor according to claim 3, wherein a first virtual extension line that extends through the center of the opening and a second virtual extension line that extends through the center of the opening in a direction substantially perpendicular to the first virtual extension line are defined, and wherein a shortest distance from the first virtual extension line to one of the plurality of reinforcing ribs at a predetermined distance from the second virtual extension line is less than a shortest distance from the center of the opening to the one of the plurality of reinforcing ribs along the second virtual extension line.

6. The linear compressor according to claim 1, wherein a plurality of coupling holes configured to be coupled to a plurality of coupling holes of the supporter by a plurality of coupling members is provided in the flange, and wherein the plurality of reinforcing ribs is located in an area in which the plurality of coupling holes is provided.

7. The linear compressor according to claim 1, wherein a supporter communication hole to guide a flow of a refrigerant gas in the shell is provided in the supporter, wherein a flange communication hole coupled to the supporter communication hole is provided in the flange, and wherein the plurality of reinforcing ribs is located in an area in which the flange communication hole is provided.

8. The linear compressor according to claim 1, wherein the at least one spring includes:

a plurality of first springs provided on upper and lower portions of the supporter; and a plurality of second springs provided on left and right portions of the supporter.

9. The linear compressor according to claim 8, further including:

a stator cover provided on a first side of the supporter, the stator cover being coupled to the plurality of first springs; and a back cover provided on a second side of the supporter, the back cover being coupled to the plurality of second springs.

10. The linear compressor according to claim 9, wherein the plurality of reinforcing ribs is provided on an upper portion of the coupling surface corresponding to an upper portion of the supporter and a lower portion of the coupling surface corresponding to a lower portion of the supporter.

11. The linear compressor according to claim 8, wherein a direction of a force acting from the stator cover by the plurality of first springs and a direction of a force acting from the back cover by the plurality of second springs are opposite to each other.

12. The linear compressor according to claim 1, wherein the flange, the supporter, the connection member, and the piston guide are coupled to each other by at least one coupling member.

13. The linear compressor according to claim 1, wherein the plurality of reinforcing ribs is provided to contact the piston guide.

14. The linear compressor according to claim 1, wherein each of the piston and the cylinder is formed of aluminum or an aluminum alloy.

15. The linear compressor according to claim 1, wherein the plurality of reinforcing ribs is integrated with the flange.

16. The linear compressor according to claim 1, wherein the plurality of reinforcing ribs is in the form of a reinforcing plate.

17. A linear compressor, comprising:

a shell;

a cylinder provided within the shell;

a piston reciprocated within the cylinder;

a motor assembly that provides a drive force to the piston, the motor assembly including a permanent magnet;

a flange that extends from an end of the piston in a radial direction, the flange having a coupling surface; and a supporter coupled to the coupling surface of the flange to support at least one spring;

at least one reinforcing provided on the coupling surface of the flange, the at least one reinforcing rib being provided at a position to guide a deformation of the flange in a first direction when the flange and the supporter are coupled to each other, wherein, when the flange and the supporter are coupled to each other, the flange is temporarily deformed in the first direction, and when the supporter and the at least one spring are thereafter coupled to each other, the flange is temporarily deformed in a second direction to return it to its original shape.

18. The linear compressor according to claim 17, wherein the at least one reinforcing rib is in the form of a reinforcing plate.

19. The linear compressor according to claim 17, wherein the first direction and the second direction are substantially perpendicular to each other.

20. A linear compressor, comprising:

a shell;

a cylinder provided within the shell;

a piston reciprocated within the cylinder, the piston having a flow space in which a refrigerant flows;

a motor assembly that provides a drive force to the piston, the motor assembly including a permanent magnet;

a flange that extends from an end of the piston in a radial direction, the flange having at least one first coupling hole;

a supporter coupled to the flange, the support having at least one second coupling hole;

at least one spring coupled to the supporter;

at least one reinforcing rib that projects from a coupling surface of the flange to extend to the supporter and including a third coupling hole; and a coupling member coupled to the first coupling hole of the flange, the second coupling hole of the supporter and the third coupling hole of the at least one reinforcing rib, wherein the at least one reinforcing rib is in the form of a reinforcing plate.

21. The linear compressor according to claim 20, wherein the at least one reinforcing rib is provided on only a first portion of a whole area of the coupling surface.

22. The linear compressor according to claim 21, wherein when the coupling member is coupled to the first and second coupling holes, the at least one reinforcing rib guides a first deformation in a first direction on a second portion of the whole area of the coupling surface on which the at least one reinforcing rib is not provided.

23. The linear compressor according to claim 22, wherein the at least one spring includes:

a plurality of first springs provided on upper and lower portions of the supporter; and a plurality of second springs provided on left and right portions of the supporter.

24. The linear compressor according to claim 23, wherein while the supporter and the plurality of first and second springs are coupled to each other, a force that causes a second deformation in a second direction opposite to the first deformation acts on the coupling surface of the flange.

* * * * *